United States Patent [19]

Suyama

[11] 4,273,968

[45] Jun. 16, 1981

[54] ELECTROACOUSTIC TRANSDUCER WITH MAGNETIC FLUX DIRECTED SLANTLY ACROSS A DIAPHRAGM

[75] Inventor: Hideo Suyama, Yokohama, Japan

[73] Assignee: Sony Corporation, Tokyo, Japan

[21] Appl. No.: 39,909

[22] Filed: May 17, 1979

[30] Foreign Application Priority Data

May 22, 1978 [JP] Japan ..... 53/60842

[51] Int. Cl.[3] ..... H04R 7/26; H04R 9/02

[52] U.S. Cl. ..... 179/115.5 PV; 179/180

[58] Field of Search ..... 179/115.5 PV, 115.5 VC, 179/115 R, 181 R, 115 V, 180, 115.5 ES

[56] References Cited

U.S. PATENT DOCUMENTS

| | | | |
|---|---|---|---|
| 1,815,564 | 7/1931 | High | 179/115.5 PV |
| 3,066,200 | 11/1962 | Pavlak | 179/115.5 PV |
| 3,141,071 | 7/1964 | Rich | 179/115.5 PV |
| 3,898,598 | 8/1975 | Asahi | 179/115.5 PV X |
| 3,997,739 | 12/1976 | Kishikawa et al. | 179/115.5 PV |
| 4,001,552 | 1/1977 | Muller | 235/92 DN |
| 4,049,926 | 9/1977 | Kasatkin et al. | 179/115 V |

*Primary Examiner*—Thomas W. Brown

*Attorney, Agent, or Firm*—Hill, Van Santen, Steadman, Chiara & Simpson

[57] ABSTRACT

A flat type electro-acoustic transducer such as a ribbon type loudspeaker has a magnetic circuit comprising a pair of air gaps and a diaphragm having a spiral coil disposed in the air gaps. In this case, the magnetic flux in the air gaps is slantly across the diaphragm.

6 Claims, 12 Drawing Figures

ELECTROACOUSTIC TRANSDUCER WITH MAGNETIC FLUX DIRECTED SLANTLY ACROSS A DIAPHRAGM

BACKGROUND OF THE INVENTION

1. Field of the Invention

This invention relates generally to an electro-acoustic transducer and, more particularly to a loudspeaker having an improved structure.

2. Description of the Prior Art

In recent years, various types of transducers utilizing drive systems have been developed for the purpose of reproducing high fidelity sounds.

As an example of the transducers, there is proposed a so-called ribbon type transducer. FIG. 1 is a perspective view thereof. In this example, there are provided magnets 1 and 2 disposed with opposite polarity, and a magnetic circuit is established by the magnets 1, 2, a back plate 3, and magnetic pole plates 4, 5. A ribbon type vibrating diaphragm 6 made of, for example, an aluminum foil is disposed between the magnetic pole plates 4 and 5. In FIG. 1, reference numerals 7 and 8 indicate fixing pieces, and 9 and 10 lead wires connected to the diaphragm 6 made of the metal ribbon.

In the example of FIG. 1, when a sound electric signal is applied across the diaphragm 6 through the lead wires 9 and 10, the signal current flows therethrough in the direction perpendicular to the magnetic field formed by the magnetic pole plates 4 and 5. Thus, the drive power proportional to the current is given to the metal ribbon diaphragm 6 in the vertical direction, and hence the electric signal is converted into an acoustic signal. While, when an acoustic signal is applied to the metal ribbon diaphragm 6, this diaphragm 6 is moved or vibrated in the magnetic field and hence the current proportional to the movement flows through the diaphragm 6 i.e. the acoustic signal is converted into the electric signal.

In the transducer of FIG. 1, if the metal ribbon diaphragm 6 is made of a metal foil such as an aluminum, since the impedance of the metal foil is very low such as about 0.1Ω, an output impedance 8Ω of an ordinary amplifier can not be applied thereto as it is. Thus, for example, a matching transformer 11 is necessary.

Further, there has been proposed another electro-acoustic transducer as shown in FIG. 2 which is a cross-sectional view thereof and FIG. 3 which is a perspective view thereof. In this example, for example, on a plastic film 12 there is provided a spiral conductor 13 to form a vibrating diaphragm 14. At the center thereof there is located a magnet 15 which has a center pole 16 of a triangular shape in cross-section on its one pole (N-pole) and a yoke 17 of a U-shape opened upwards on the other pole (S-pole). Upper plates 18 and 19 are provided on the upper end edges of the yoke 17 in opposed relation at both sides of the center pole 16, and the diaphragm 14 is stretched between the upper plates 18 and 19 with the center portion of the diaphragm 14 being fixed to the center pole 16.

According to the prior art example of FIGS. 2 and 3, magnetic fields opposite in polarity are established between the upper plate 18 and the center pole 16 and between the upper plate 19 and the center pole 16, respectively. Because the conductor 13 of the diaphragm 14 is spiral, when an acoustic signal current is applied between both ends of the conductor 13 through the lead wires 9 and 10, the signal current flowing through the spiral conductor 13 is opposite in direction at the left and right sides of the center of diaphragm 14. As a result, the film 12 is vibrated in the same direction at the left and right sides of the center thereof and hence the electric signal is converted into an acoustic signal. By the reverse of the process, when an acoustic signal is applied to the diaphragm 14, it is converted into an electric signal. In this latter case, a sufficiently high impedance can be achieved by selecting a sufficiently long length of the conductor 13.

According to the transducer of FIGS. 2 and 3, however, since the diaphragm 14 is fixed to the center pole 16 and upper plates 18 and 19, the effective vibrating area of the diaphragm 14 becomes small and hence the frequency characteristics in the low frequency band can not be expanded. Further, the magnetic fields are established between the center pole 16 and upper plates 18, 19 but, as shown in FIG. 2, almost all of the fluxes from the center pole 16 to the plates 18 and 19 do not pass through the diaphragm 14 (refer to ΦA in FIG. 2) or are a so-called ineffective flux. In fact, the flux passing through the diaphragm 14 (refer to ΦB in FIG. 2) gives a drive force to the conductor 13, but this drive flux is a so-called leakage flux. As set forth above, the transducer of FIGS. 2 and 3 produces the drive force by the leakage flux, so that its utilization factor is low. In other words, if a magnet with great magnetomotive force is not used, a transducer having a necessary output cannot be provided. Thus, a large and expensive magnet such as an Alnic (Trade Name) magnet is necessary and hence the cost of the transducer becomes high.

Though not shown, such a transducer is also proposed in which a first magnetic plate having a number of magnetic pole pieces and a second magnetic plate having a number of magnetic pole pieces are located parallel with each other and a vibrating diaphragm having a conductor pattern is located between the first and second magnetic plates. In this transducer, the flux passes through the conductor parallel or slant thereto to produce the drive force. Further, since the diaphragm can be increased in effective vibration area, this transducer can reproduce a frequency lower than that of the ribbon type transducer. However, there is such a drawback that the magnetic circuit is complicated, it is rather difficult to assemble the parts, and a magnet with great magnetomotive force is required.

OBJECTS AND SUMMARY OF THE INVENTION

Accordingly, an object of this invention is to provide an improved electro-acoustic transducer free from the defect encountered in the prior art.

Another object of this invention is to provide an electro-acoustic transducer in which the magnetic flux is passed through a diaphragm with a conductor slantly to improve the converting efficiency.

A further object of the invention is to provide an electro-acoustic transducer in which magnetic air gaps are formed by a pair of plates and a center pole located between the plates, and a diaphragm with a conductor is located slantly with respect to the flux in the magnetic air gaps so as to make the flux pass through the conductor effectively.

A further object of the invention is to provide an electro-acoustic transducer in which a step portion is formed in each of a pair of magnetic plates and a diaphragm is located on the step portions to reduce leakage flux and hence to make the flux pass through the conductor of the diaphragm effectively.

A still further object of the invention is to provide an electro-acoustic transducer in which magnetic air gaps are formed by a pair of magnetic plates and a center pole located at the mid portion of the plates, through which air gaps the magnetic flux passes slantly, a vibrating diaphragm of a plate like shape having a conductor is disposed between the center pole and the mid portion of plates, and a substantially uniform flux density is applied to the surface of the diaphragm to generate a drive force uniform all over the surface of the diaphragm.

A yet further object of the invention is to provide an electro-acoustic transducer having a damping material applied to a vibrating diaphragm to avoid undesired vibrations on the diaphragm.

A further object of the invention is to provide an electro-acoustic transducer in which a spiral conductor is formed on a thin film made of non-conductive material with the number of concentric turns of the spiral being as many as possible to reduce the area of the non-conductive material as much as possible and hence to avoid bad influences caused by unnecessary operation of the non-conductive material.

According to an aspect of the present invention there is provided an electro-acoustic transducer which comprises a magnetic circuit consisting of a pair of permanent magnets parallely positioned with each other, a yoke magnetically coupled to the magnets and having a center pole and a pair of plates magnetically coupled to the magnets, the center pole being positioned between the plates, a pair of air gaps formed by the center pole and plates, and a diaphragm having a conductor disposed in the air gaps, wherein the plates position above one side surface of the diaphragm and the center pole positions under the other side surface of the diaphragm, whereby magnetic flux passes through the air gaps so as to be slantly across the conductor of the diaphragm.

The other objects, features and advantages of the invention will be apparent from the following description taken in conjunction with the accompanying drawings.

DESCRIPTION OF THE PREFERRED EMBODIMENTS

Figure 1:
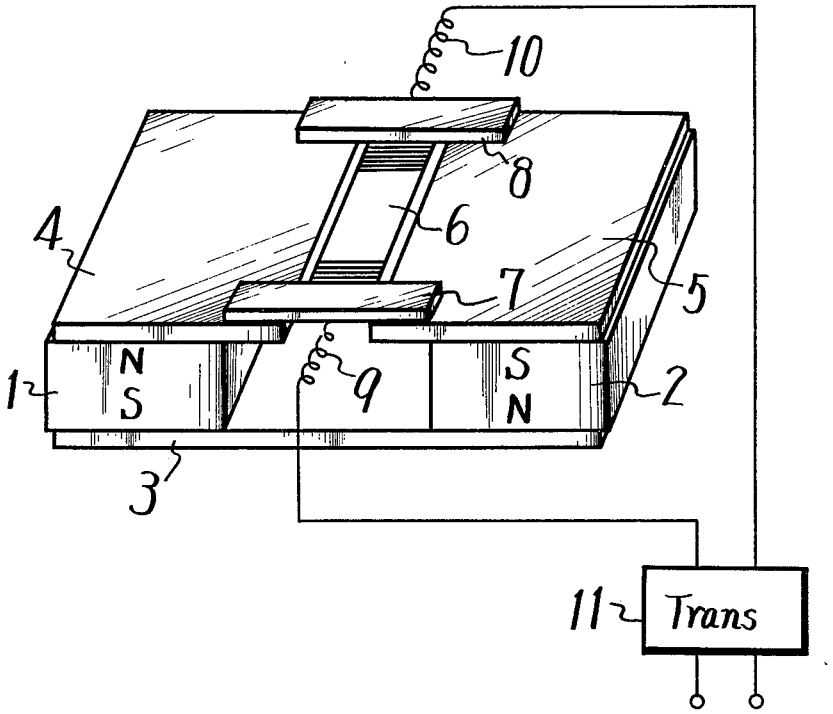
FIG. 1 (PRIOR ART)
FIG. 1 is a perspective view schematically showing a prior art electro-acoustic transducer of the ribbon type.
Figure 2:
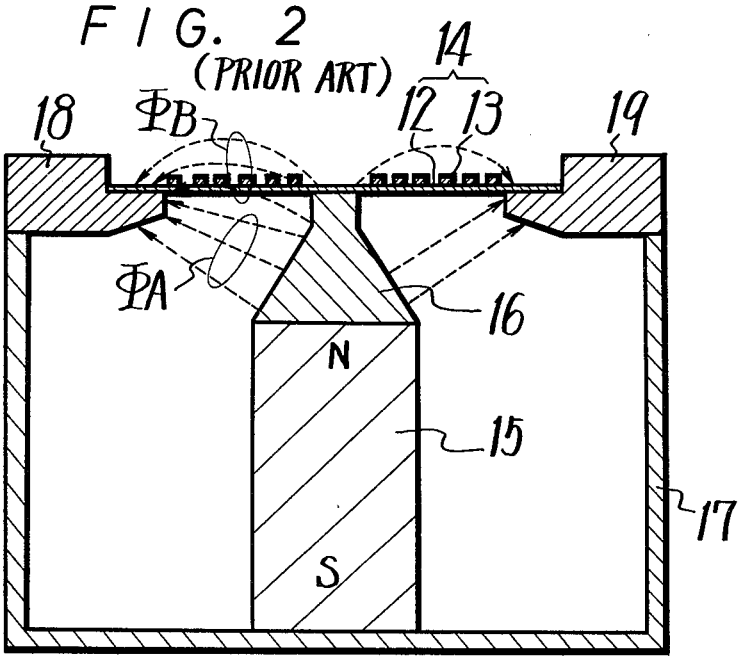
FIG. 2 (PRIOR ART)
FIG. 2 is a cross-sectional view of another prior art electro-acoustic transducer of the ribbon type.
Figure 3:
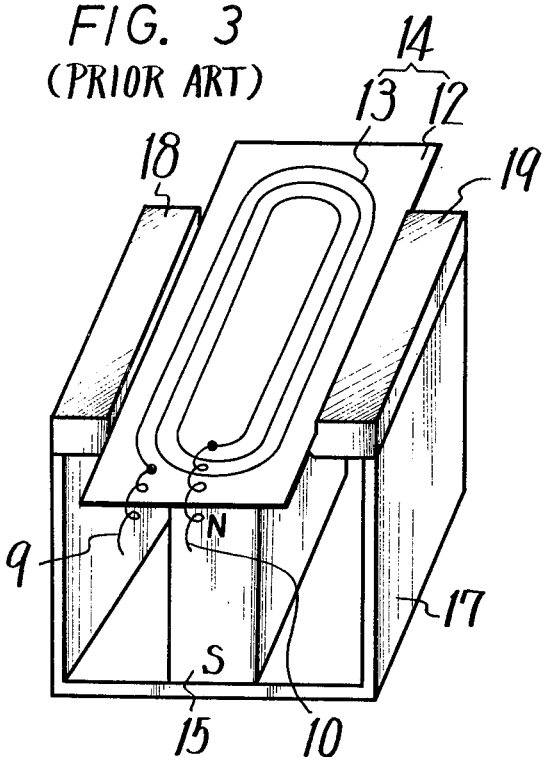
FIG. 3 (PRIOR ART)
FIG. 3 is a schematic perspective view of the electro-acoustic transducer shown in FIG. 2.
Figure 4:
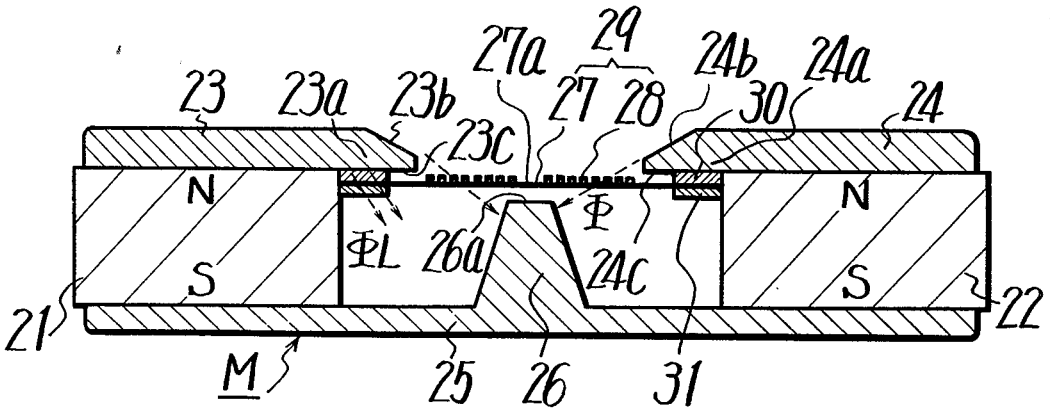
FIG. 4 is a cross-sectional view showing an example of the electro-acoustic transducer according to the present invention.

An example of the electro-acoustic transducer according to this invention will be described with reference to FIGS. 4 and 5. In this example of the invention, a magnetic circuit M is formed by a pair of rectangular permanent magnets 21 and 22, which are disposed parallel with each other, a yoke 25 having a center pole 26, and a pair of magnetic plates 23 and 24, which are coupled to the magnets 21 and 22, respectively. In this case, a pair of magnetic air gaps are formed between the center pole 26 and the plates 23 and 24, respectively. The plates 23 and 24 have end portions **23*a* and 24*a* which are extended from the magnets 21 and 22 toward the center pole 26 and which have tapered surfaces 23*b* and 24*b*, respectively. In this case, lower surfaces 23*c* and 24*c*, of the end portions 23*a* and 24*a* are made flat. The center pole 26 is so located that the central axis thereof is positioned along the center between the end portions 23*a* and 24*a* of the plates 23 and 24 and its top surface 26*c* is positioned under lower surfaces 23*c* and 24*c* of the plates 23 and 24 as shown in FIG. 4. Thus, the magnetic fluxes emanated from both the plates 23 and 24 go to the center pole 26** after slantly passing through the air gaps, respectively.

Figure 5:
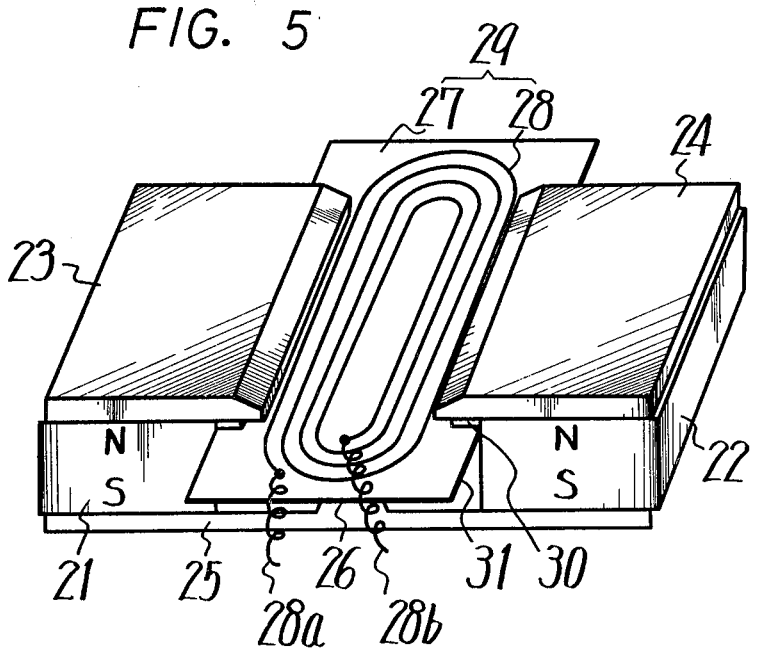
FIG. 5 is a schematic perspective view of the example of the invention shown in FIG. 4.

As shown in FIG. 5, a rectangular vibrating diaphragm 29 consists of a rectangular film 27 made of, for example, polymer plastics and a conductor 28 formed by the printing technique on the film 27 with a rectangular and spiral shape. The conductor 28 has lead wires **28*a* and 28*b* connected to its input and output terminals. A spacer 30 and a fixing piece 31 are bonded to the upper and lower surfaces of the film 27 along each of the left and right sides thereof, and the diaphragm 29 is fixed to the lower surfaces 23*c* and 24*c* of the end portions 23*a* and 24*a* of plates 23 and 24 through spacers 30 by adhesive agent. Thus, the diaphragm 29 is so disposed that the conductor 28 thereof is located within the air gaps formed by the end portions 23*a*, 24*a* of plates 23, 24 and the center pole 26 and magnetic fluxes Φ originated from the plates 23, 24 pass through the conductor 28 slantly and arrive at the center pole 26. In this case, the inner most conductor pattern of the conductor 28 formed on the film 27 is positioned above the extension of a top surface 26*a* of the center pole 26, and the inside of the inner most conductor pattern or the portion of the film 27 above the top surface 26*a* of the center pole 26 is a narrow film portion 27*a* which has no conductor pattern. Further, between the lower surface of the diaphragm 29 and the top surface 26*a* of the center pole 26** there is formed a suitable clearance or air gap.

Accordingly, in the example of the invention shown in FIGS. 4 and 5, magnetic fields are provided between the center pole 26 and the magnetic plates 23, 24, respectively. When a signal current is applied to the conductor 28 on the film 27, the direction of the signal current flowing through the left portion of the conductor 28 is opposite to that flowing through the right portion of the conductor 28. Thus, the film 27 of the diaphragm 29 is driven and accordingly, the electric signal is converted into an acoustic signal. Similarly, an acoustic signal applied to the diaphragm 29 is converted into an electric signal which is delivered through the lead wires **28*a* and 28*b***.

As set forth above, according to the transducer of the invention shown in FIGS. 4 and 5, an electric signal is converted into an acoustic signal or vice versa. In this invention, since the diaphragm 29 is positioned between the magnetic plates 23, 24 and the center pole 26, the fluxes formed between the center pole 26 and the magnetic plates 23, 24 intersect the conductor 28 of the diaphragm 29 and hence the utilization factor of the magnets 21, 22 is high. Further, since the center pole 26 is spaced apart from the diaphragm 29 with a suitable clearance, the area of the diaphragm 29, which is practically vibrated, is large and accordingly, the diaphragm 29 can be vibrated suitably at a low frequency. Further, since an outer type magnet can be used as the magnets 21 and 22, an inexpensive magnet such as a ferrite magnet can be employed and hence the transducer can be made cheap.

An example of the method to provide the diaphragm 29 is that on one surface of the film there is formed an aluminum layer by the lamination or vaporization and then the aluminum layer is subjected to the photoetching process to remove undesired portions.

Figure 6:
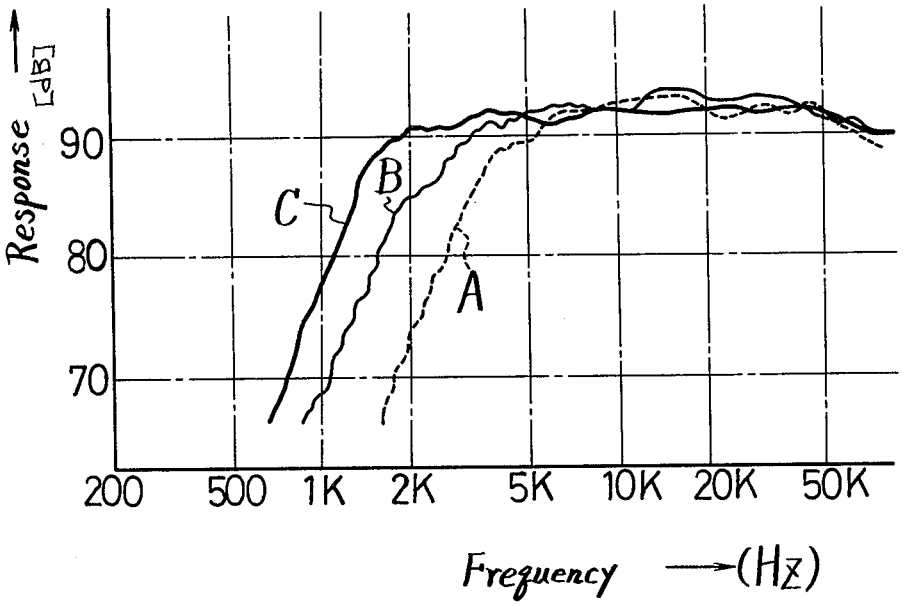
FIG. 6 is a frequency characteristic graph thereof.

FIG. 6 is a graph showing the frequency characteristics of the transducers shown in FIGS. 1, 2, 3, 4 and 5 which are provided by experiments. In the graph of FIG. 6, a curve A represents the frequency characteristic of the transducer shown in FIG. 1, a curve B that of the transducer shown in FIGS. 2 and 3, and a curve C that of the transducer of the invention shown in FIGS. 4 and 5, respectively. As may be apparent from the graph of FIG. 6, the low frequency characteristic of this invention is expanded lower than 2 $KH_z$.

Figure 7:
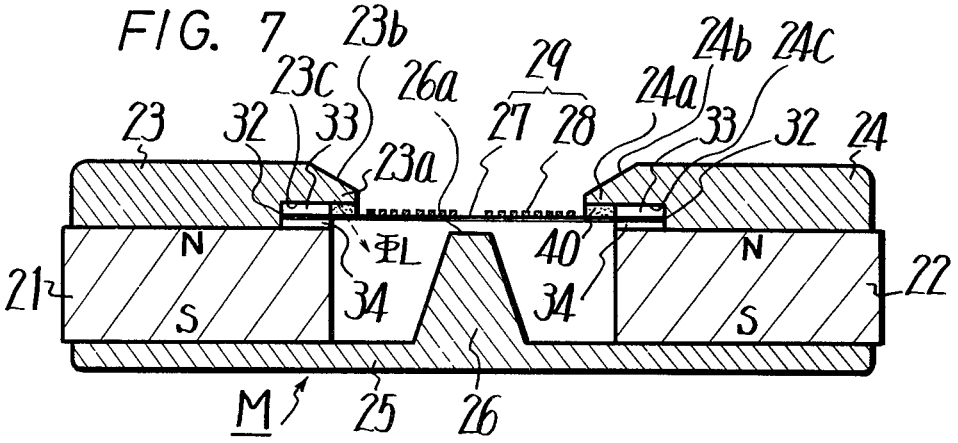
FIGS. 7 and 8 are cross-sectional views respectively showing other examples of the invention.
Figure 8:
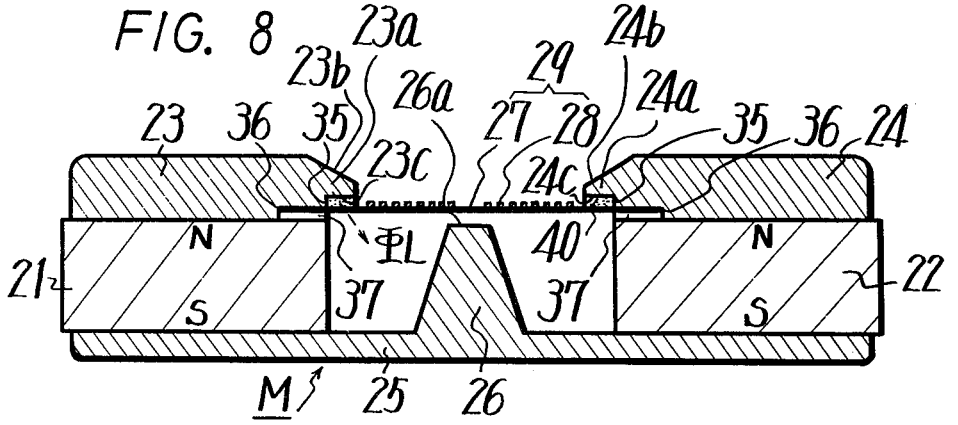

FIGS. 7 and 8 are cross-sectional views showing other examples of the transducer according to the present invention, respectively.

In the example of the invention shown in FIG. 7, a recess or stepped portion 32 is formed on the lower surface 23*c* and 24*c* of the end portions 23*a* and 24*a* of the magnetic plates 23 and 24. That is, the stepped portions 32 are formed by the upper surfaces of the magnets 21, 22 near the center pole 26 and the lower surfaces 23*c*, 24*c* of the end portions 23*a*, 24*a* of the magnetic plates 23, 24 near the center pole 26. The diaphragm 29 is gripped between the stepped portions 32 through spacers 33, 34 inserted into the stepped portions 32 similar to the example shown in FIGS. 4 and 5.

Figure 9:
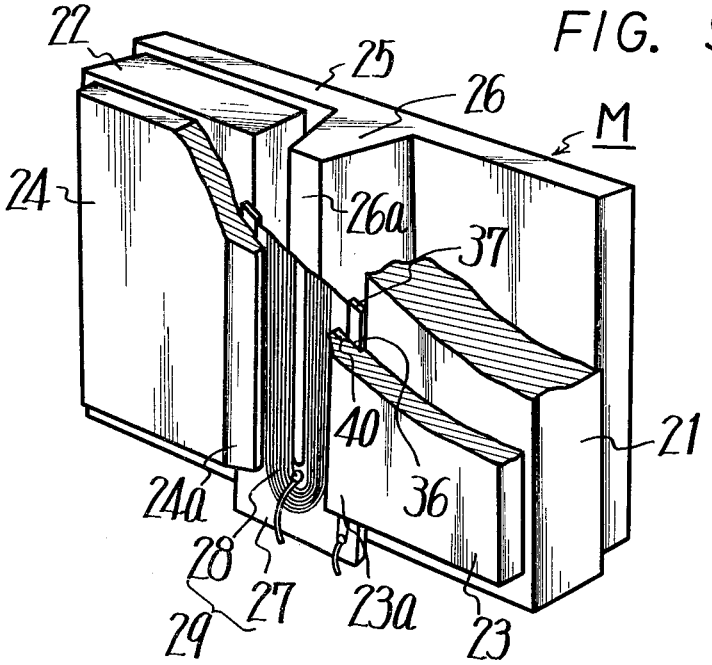
FIG. 9 is a perspective view, partially cut out, showing a part of the example shown in FIG. 8.

In the transducer of the invention shown in FIG. 8, two stepped portions 35 and 36 are formed on the lower surface of each of the end portions 23*a* and 24*a* of the magnetic plates 23 and 24, respectively, and the diaphragm 29 is gripped between the magnetic plates 23 and 24 by inserting spacers 37 into both the lower stepped portions 36 above the magnets 21 and 22. In this connection, refer to FIG. 9 which is a perspective view of FIG. 8, partially cut away.

According to the examples of the invention shown in FIGS. 7 and 8 in which the magnetic plates 23 and 24, each having the stepped portion or portions are fixed to the upper surfaces of the magnets 21 and 22, the attachment of the diaphagm 29 to the magnetic circuit becomes very easy. Further, when the distances i.e. air gaps between the center pole 26 and the magnetic plates 23, 24 similar to the transducer shown in FIGS. 4 and 5 are utilized, the transducers shown in FIGS. 7 and 8 are less in leakage fluxes ΦL from the plates 23, 24 to the center pole 26 and hence are good in efficiency. That is, in the transducer shown in FIGS. 4 and 5, the portions of the plates 23, 24 extended from the magnets 21, 22 to the center pole 26 are rather long, so that the leakage fluxes ΦL directed from the roots of the plates 23, 24 to the center pole 26 (refer to FIG. 4) increase. On the contrary, such leakage fluxes ΦL in the examples of FIGS. 7 and 8 are less.

Further, in the examples of FIGS. 7 and 8, the magnetic air gaps formed by the magnetic plates 23, 24 and the center pole 26 slantly intersect the plane on which the diaphragm 29 is positioned. If the diaphragm 29 is positioned at substantially mid portion of the air gap between the top surface 26*a* of the center pole 26 and the lower surfaces of the magnetic plates 23 and 24, and the angle at which the flux intersects the diaphragm 29 is selected about 30°, the conductor 28 on the film 27 is given with approximately uniform flux density in the horizontal direction.

Figure 10A:
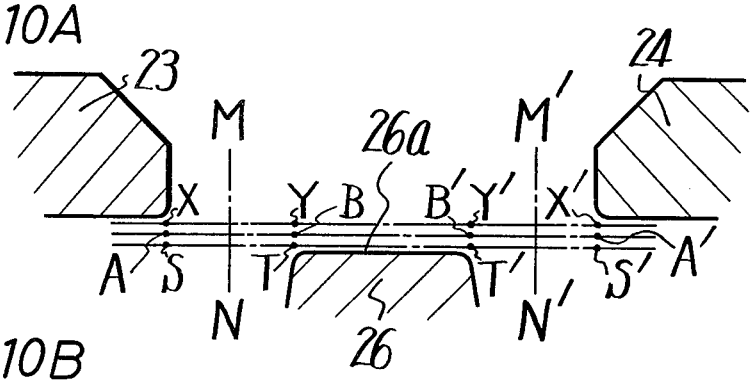
FIG. 10A is an enlarged side view of the air gap and surrounding structure shown in FIG. 8
Figure 10B:
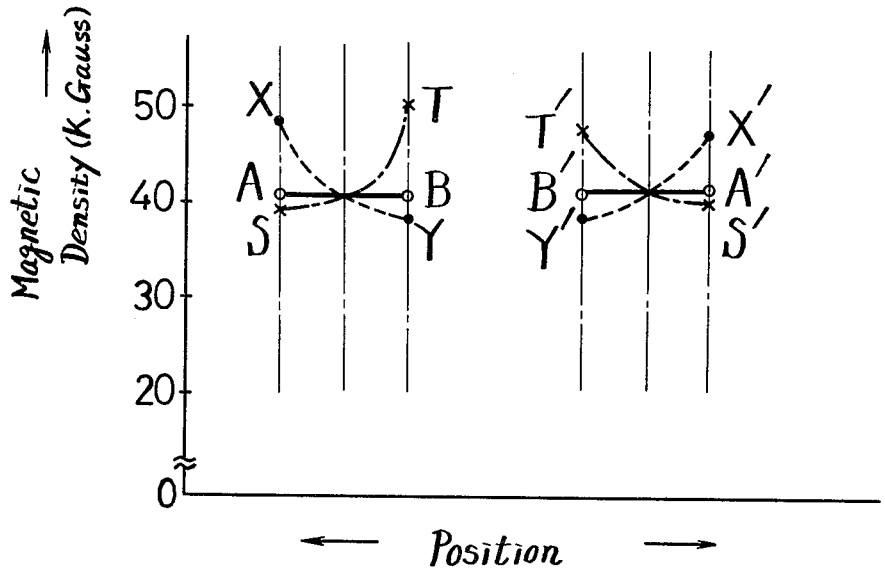
FIG. 10B is a spatially-aligned graph showing the flux density in the air gap.

If the clearance between the top surface 26*a* of the center pole 26 and the lower surfaces of the magnetic plates 23, 24 are divided into three planes as shown in FIG. 10A, the flux density on the plane X—Y and plane S—T in the left side air gap is varied much in accordance with the horizontal position as shown in FIG. 10B. Similarly, in the right side air gap, the flux density is varied much on the planes Y′—X′ and T′—S′ in accordance with the horizontal position. While, on the intermediate planes A—B and B′—A′ at the left and right side air gaps, the flux density is approximately uniform regardless of the horizontal position. If such a uniform flux density is applied to the conductor, the force for driving the diaphragm is constant all over the diaphragm, which is very desirable for the reproducing frequency characteristics.

In general, a part of the diaphragm on which no conductor is formed is apt to be vibrated undesirably when the transducer is operated. However, according to the transducer of the invention, a part of the diaphragm on which no conductor is formed is only such a part which corresponds to the top surface of the center pole and which is very small in area. Accordingly, it can be avoided by this invention as much as possible that the diaphragm is subjected to an undesirable vibration.

Figure 11:
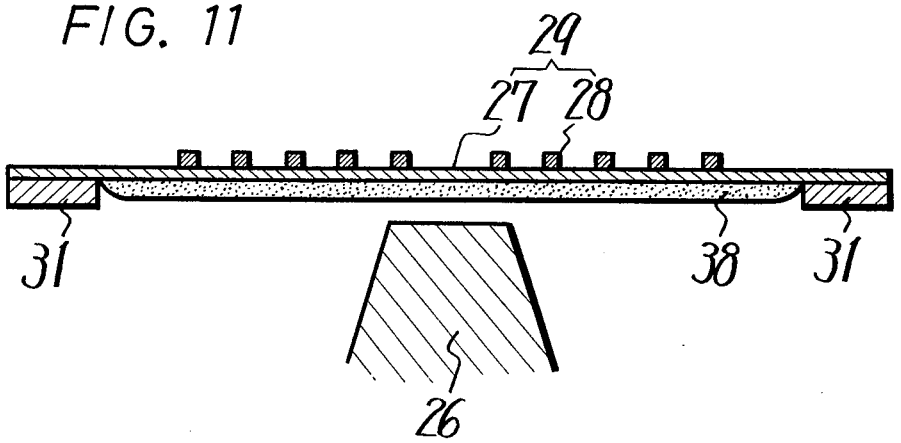
FIG. 11 is a cross-sectional view showing another example of the diaphragm used in the invention.

The damping for the entire diaphragm can be carried out by coating a damping material 38 on the lower surface of the film 27 of the diaphragm 29 as shown in FIG. 11.

Further, the damping for the periphery of the diaphragm 29 can be carried out by damping materials 40 provided between the lower surfaces of the plates 23, 24 and the diaphragm 29 as shown in FIGS. 7 and 8.

It will be apparent that many modifications and variations could be effected by one skilled in the art without departing from the spirits or scope of the novel concepts of the invention.

I claim as my invention:

1. An electroacoustic transducer comprising:

(a) a magnetic circuit consisting of a pair of permanent magnets parallely positioned with respect to each other;

(b) a yoke magnetically coupled to said pair of magnets and having a center pole and a pair of plates magnetically coupled to said magnets, said center pole being postioned equidistant from said plates;

(c) a pair of air gaps formed by said center pole and each of said plates; and (d) a diaphragm having a conductor disposed in said air gaps, wherein said plates position above one side surface of said diaphragm and said center pole positions under the other side surface of said diaphragm, whereby magnetic flux flows through said air gaps so as to be slantly across the conductor of said diaphragm.

2. An electroacoustic transducer as claimed in claim 1, in which each of said plates consists of a portion coupled to each of said magnets and an end portion extending toward said center pole, a stepped portion is formed on the lower surface of said end portion, and said diaphragm is disposed in said stepped portion.

3. An electroacoustic transducer as claimed in claim 2, in which a damping material is disposed between said stepped portion and said diaphragm.

4. An electroacoustic transducer as claimed in claim 2, in which a second stepped portion is further formed on the end portion of each of said plates and a damping material is disposed in said second stepped portion to be in contact with the periphery of said diaphragm.

5. An electroacoustic transducer as claimed in claim 1, in which said diaphragm is positioned at a mid portion between a top of said center pole and said plates, and the inclination angle of magnetic flux across said conductor is selected about 30°.

6. An electroacoustic transducer as claimed in claim 1 or 5, in which said diaphragm consists of a plastic film and a spiral conductor formed on said plastic film, said spiral conductor having an inner-most portion which is positioned above a top surface of said center pole.

* * * * *